US007927005B2

(12) United States Patent
Friedman

(10) Patent No.: US 7,927,005 B2
(45) Date of Patent: Apr. 19, 2011

(54) TRACK LIGHTING CONSTRUCTION

(75) Inventor: Robert E. Friedman, Brooklyn, NY (US)

(73) Assignee: Nulux, Inc., Ridgewood, NY (US)

( * ) Notice: Subject to any disclaimer, the term of this patent is extended or adjusted under 35 U.S.C. 154(b) by 133 days.

(21) Appl. No.: 12/239,592

(22) Filed: Sep. 26, 2008

(65) Prior Publication Data

US 2009/0080202 A1 Mar. 26, 2009

Related U.S. Application Data

(60) Provisional application No. 60/975,259, filed on Sep. 26, 2007.

(51) Int. Cl.
*H01R 33/00* (2006.01)

(52) U.S. Cl. ..... 362/648; 362/362

(58) Field of Classification Search ..... 362/362, 362/382, 648, 348

See application file for complete search history.

(56) References Cited

U.S. PATENT DOCUMENTS

| | | | | |
|---|---|---|---|---|
| 3,246,074 | A | 4/1966 | Neumann et al. | |
| 4,032,775 | A * | 6/1977 | Bobrick et al. | 362/426 |
| 4,218,108 | A | 8/1980 | El Mouchi | |
| 4,688,154 | A | 8/1987 | Nilssen | |
| 4,822,292 | A | 4/1989 | Thayer et al. | |
| 4,881,907 | A | 11/1989 | Bergman et al. | |
| 4,887,196 | A | 12/1989 | Brown et al. | |
| 5,803,755 | A | 9/1998 | Kuchar et al. | |
| 6,515,437 | B1 | 2/2003 | Zinkler et al. | |
| 6,597,129 | B2 | 7/2003 | Newman | |
| D488,878 | S | 4/2004 | Ward | |
| D499,698 | S | 12/2004 | Ramirez | |
| 2003/0021111 | A1 * | 1/2003 | Miller et al. | 362/226 |
| 2005/0152132 | A1 * | 7/2005 | Bernhart et al. | 362/147 |
| 2005/0254262 | A1 * | 11/2005 | Chiu | 362/648 |
| 2007/0115694 | A1 * | 5/2007 | Mobarak et al. | 362/648 |

OTHER PUBLICATIONS

LiteLab Corp. Catalog, "R1a BusRun PowerGrids," Fall 2002.
Lucifer Lighting Company product specification for adjustable spotlights, copyright 1999.

* cited by examiner

*Primary Examiner* — Evan Dzierzynski
(74) *Attorney, Agent, or Firm* — Leason Ellis LLP

(57) ABSTRACT

A track lighting system comprises an extruded track body, having adjacent first and a second track sections; a defined entrance to the track body that is common to both the first and the second track sections, a respective conductive member connectable to an electrical power source disposed at a bottom of each of the first and the second track sections so as to form two independent circuits within the extruded track body; and a separating wall positioned between the first track and the second track. The system further comprises a light fixture insertable through the entrance so as to make electrical connection with one of the conductive members, the fixture comprising: a socket housing a stem connecting the socket housing to a transformer housing containing an electrical circuit having an output transformer; a lamp in electrical connection with the output transformer by wires within the stem; and the transformer housing including a wall having first and second contact slots formed therein.

15 Claims, 14 Drawing Sheets

TRACK LIGHTING CONSTRUCTION

CLAIM OF PRIORITY

This patent application claims the benefit of priority, under 35 U.S.C. §119, of U.S. Provisional Application Ser. No. 60/975,259, filed Sep. 26, 2007, titled "Track Lighting Construction," the entire content of which is incorporated herein by reference.

TECHNICAL FIELD

The present invention relates to track lighting and more particularly, to track lighting that has a two circuit angled track construction that has a reduced width track opening (entrance) and is constructed so that the transformer is disposed within the track during use.

BACKGROUND

Track lighting offers a contemporary look and is a method of lighting where light fixtures are attached to a track which conducts electricity. Tracks can be mounted to ceilings or walls, lengthwise down beams, or crosswise across rafters or joists or the like. Track lighting can also be designed so that it can be hung with rods from especially high places, such as vaulted ceilings, etc. In the United States, track lighting systems have line voltage of 120 volts running through a recessed track. The track can have a second "hot" conductor so that two circuits can control lighting on the same track. This is selected by placing the tab of the connector on the fixture to one side of the tack or the other side of the track when attaching the fixture to the track.

Since track lighting fixtures are typically low voltage devices, all low voltage track lighting fixtures styles are equipped with a self-contained electronic transformer that brings the line voltage of approximately 120 volts down to 12 volts, to make the voltage suitable for low voltage lamps (light bulbs). The transformer can be in the form of a rectangular block that serves as both the base of the fixture and the connection to the track.

As homeowners continue to demand smaller and sleeker tracking lighting systems, there is a need to construct the track and lighting fixture and in particular, the transformer thereof, to have reduced dimensions, while still offering an attractive, contemporary design.

SUMMARY OF THE INVENTION

In one aspect, the invention provides a track lighting system comprising: an extruded track body, comprising: a first track section and a second track section adjacent to the first track section; a pair of spaced rails defining an entrance into the extruded track body, wherein the defined entrance is common to both the first track section and the second track section; a respective conductive member disposed at a bottom of each of the first track section and the second track section, wherein the conductive member is connectable to an electrical power source so as to form two independent circuits within the extruded track body; and a separating wall positioned between the first track and the second track; a light fixture insertable through the entrance so as to make electrical connection with one of the respective conductive members, the light fixture comprising: a socket housing containing a socket, a stem connecting the socket housing to a transformer housing containing an electrical circuit having an output transformer; a lamp in electrical connection with the socket, and connected to the output transformer by wires disposed within the stem; and the transformer housing including a top wall having first and second contact slots formed therein.

BRIEF DESCRIPTION OF THE DRAWING FIGURES

DETAILED DESCRIPTION OF EMBODIMENTS

Further aspects and features of the exemplary recessed track lighting system disclosed herein can be appreciated from the appended Figures and accompanying written description.

By way of overview and introduction, embodiments of the invention provide a track lighting system having a reduced width (e.g., 13/32") track entrance to permit reception of a reduced width (e.g., 3/8") transformer. The track also includes two angled track sections that each contain its own circuit and the transformer is constructed so that it can be inserted into either of the track sections so long as the orientation of the transformer is proper relative to the specific track section as described below.

Figure 1:
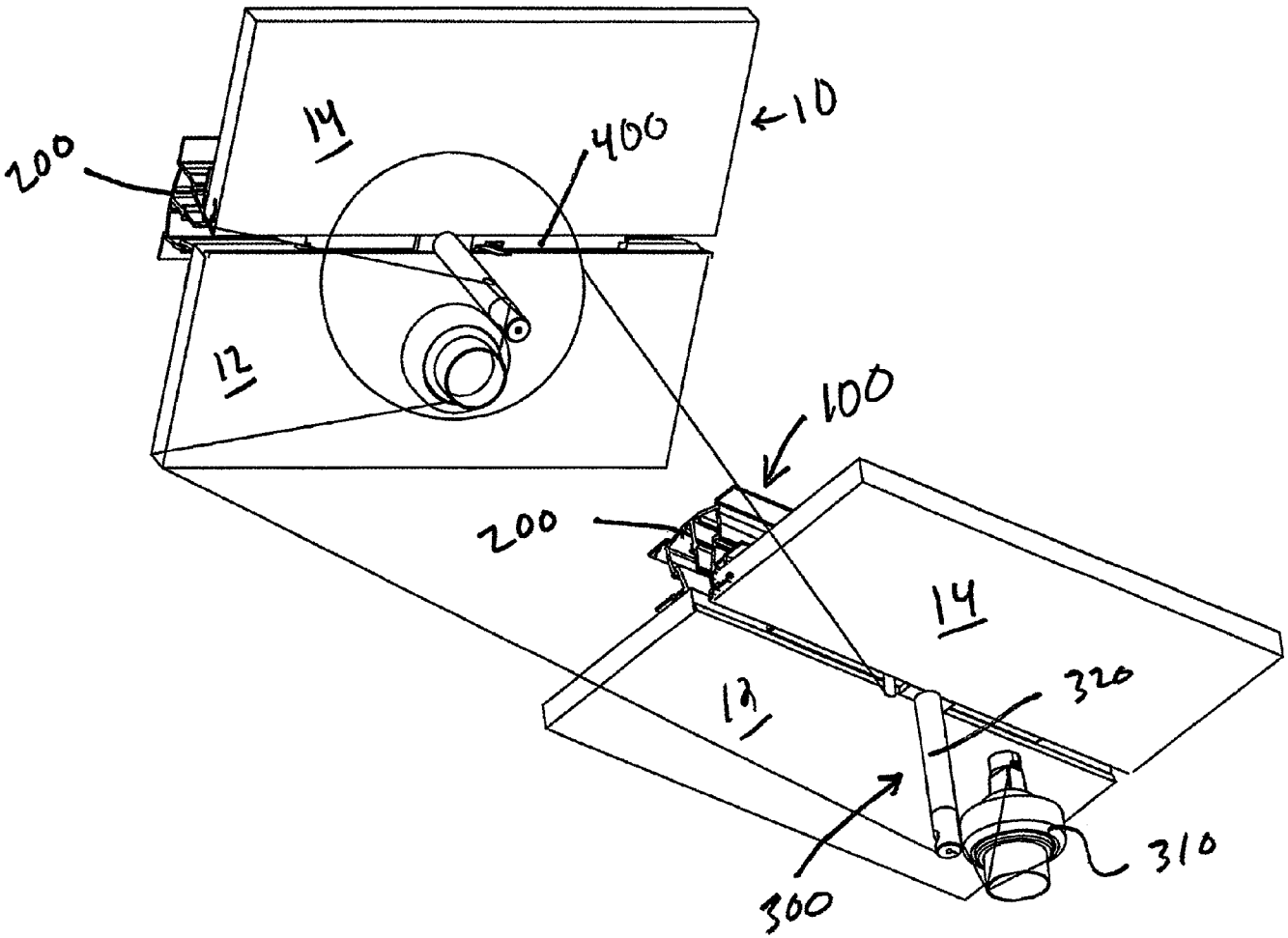
FIG. 1 shows perspective views showing a recessed track lighting system of the present invention installed in a support structure, such as a ceiling.

FIG. 1 shows a recessed track lighting construction (system) 100 according to one embodiment of the present invention. The track lighting system 100 is mounted in and to a support structure 10, such as a ceiling, and as illustrated, the system 100 is installed behind and between a first support structure 12 (e.g., first piece of drywall) and a second support structure (e.g., second piece of drywall) 14. As explained below, one of the advantages of the present invention is that the space between the two structures 12, 14 is reduced compared to existing systems so as to offer a cleaner, sleeker appearance. For example, the space between the two can be slightly larger than the track entrance width which is about 13/32". The system 100 is generally formed of an elongated track 200, a lighting fixture 300 including a lamp 310, a stem 320 that is attached between the lamp 310 and a transformer 400 that is electrically connected to the track 200.

As shown in FIGS. 2-7, the track 200 is constructed as an extruded structure and is constructed to include two different circuits (it will be appreciated that other methods can be used to make the track 200). The illustrated track 200 is of a two circuit, four wire, 120 volt construction. The track 200 is typically an extruded structure and is formed of a metal material, such as aluminum. The track 200 includes a first track section 210 and an adjacent second track section 220. As described below, it will be appreciated that the lighting fixture 300 and in particular, the transformer 400 thereof is constructed to be received into one of the first and second track sections 210, 220 depending upon the customer's needs and desires. The track 200 is formed of a body 202 that has a plurality of outwardly extending flanges that are designed to engage the support structure 10 for securely holding the track 200 therein. For example, the track 200 includes a first set of opposite flanges 206, a second set of opposite flanges 208 and a third set of opposite flanges 209. The first and second sets of flanges 206, 208 are located and configured to engage the first and second support structures 12, 14 (e.g., the two different dry wall pieces). When the track 200 is mounted in drywall, the inner surface or face of the drywall engages the second set of flanges 208 and a joint compound 16 (FIG. 5) contacts the first set of flanges 206.

The track 200 includes a pair of spaced rails 229 that define an entrance 230 into the body 202 of the track 200. The rails 229 are proximate the first set of flanges 206. In the illustrated embodiment, the rails 229 are angled with respect to one another and in particular, the rails 229 can be tapered inward. The entrance 230 represents a single entrance into both the first track section 210 and the second track section 220. Within each track section 210, 220 at a bottom thereof is a conductive member (contact member) 230 that is electrically connected to a power source and in the present design, each contact member 230 includes a body 232 formed of an insulating material and includes a pair of slotted sections separated by a center wall 234. Within each of the slotted sections is a conductor 236, such as a copper conductor, that is electrically connected to the power source and thus, serves to electrically connect the light fixture 300 to the track 200, when corresponding contacts of the transformer 400 are inserted therein.

Separating wall 240 separates the first and second tracks 210, 220 and is positioned to cause the placement of the transformer 400 into only one of the first and second tracks 210, 220. The height of the wall 240 is greater than the heights of the body 232 of the contact member 230 and therefore, the transformer 400 will contact the wall 240 before contacting either of the conductors 236. In accordance with one aspect of the present invention, the first and second track sections 210, 220 are angled when the track 200 is mounted in the support structure 10 and therefore, define angled receiving slots or channels for receiving the transformer 400.

It will be appreciated that track 200 is a two circuit track due to the presence of the two separate contact members 230 housed in different track sections 210, 220. The light fixture 300 is formed so that in one orientation, the fixture 300 can only be inserted into one of the tracks sections 210, 220 and in another orientation, the fixture 300 can only be inserted into the other track section 210, 220.

The lamp 310 of the light fixture 300 can be of any number of different sizes, shapes and styles. The lamp 310 has a housing 312 that contains a socket or the like that holds a light bulb. A pair of wires 314 are electrically connected to the socket and are routed through an opening 322 that is formed in the stem 320 where they are fed to and are electrically connected to the transformer 400 (e.g., to a printed circuit board thereof). The stem 320 is an elongated pole that attaches at one end to the lamp 310 and to the transformer 400 at the other end. The stem 320 is a hollow member to permit the wires 314 and other components to be disposed and routed therethrough.

As previously mentioned, the transformer 400 functions to bring the line voltage of approximately 120 volts down to a lower voltage, such as 12 volts, to make the voltage suitable for low voltage lamps (light bulbs).

In accordance with the present invention, the transformer 400 is configured to be disposed within the track 200 during operation of the track lighting system 100. More particularly, the transformer 400 can be inserted into one of the track sections 210, 220 depending upon its orientation to cause the transformer 400 to be electrically connected to one of the two circuits of the track 200.

Figure 2:
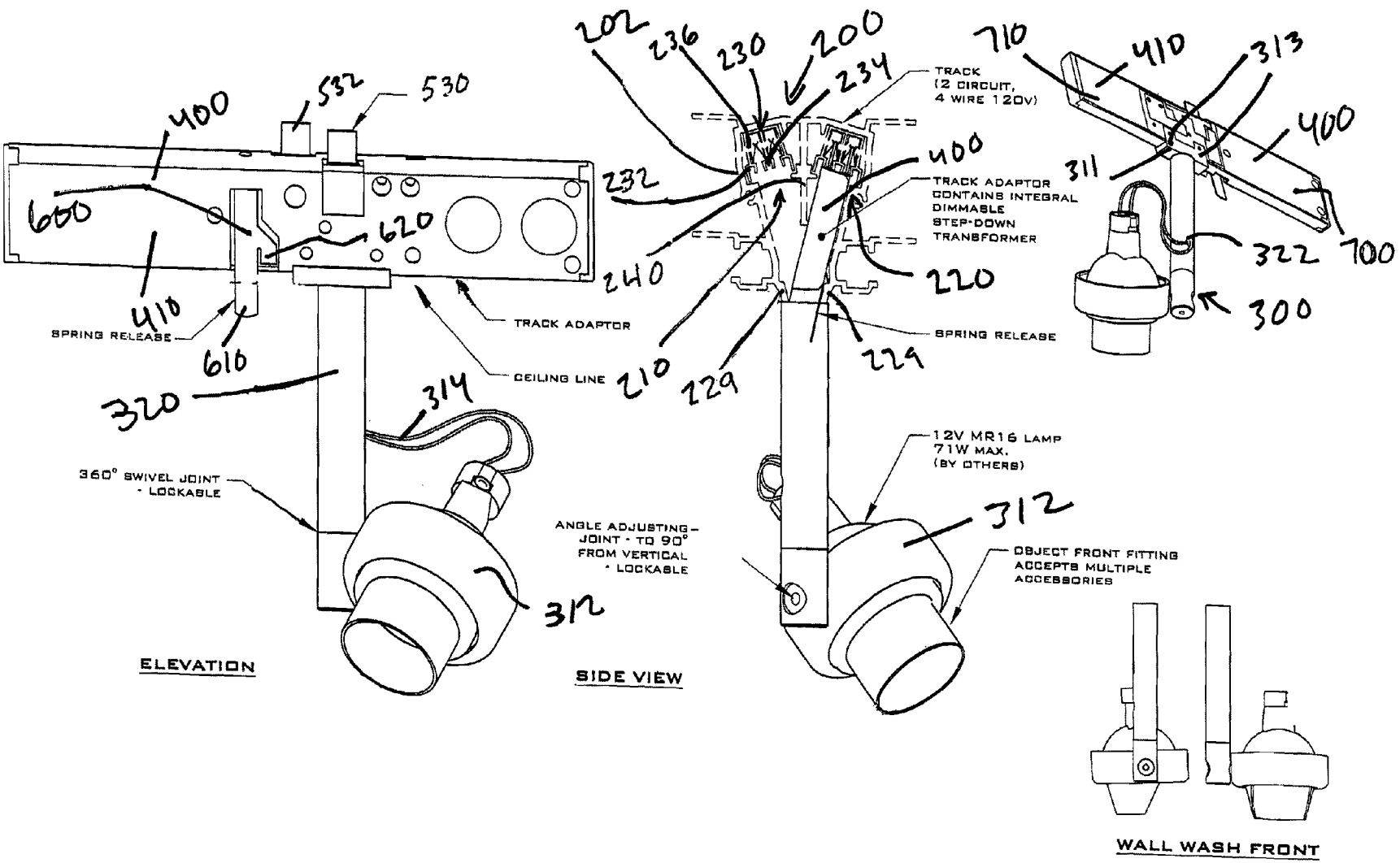
FIG. 2 shows views of an exemplary lighting fixture and transformer according to the present invention and being electrically connected to the track.
Figure 3:
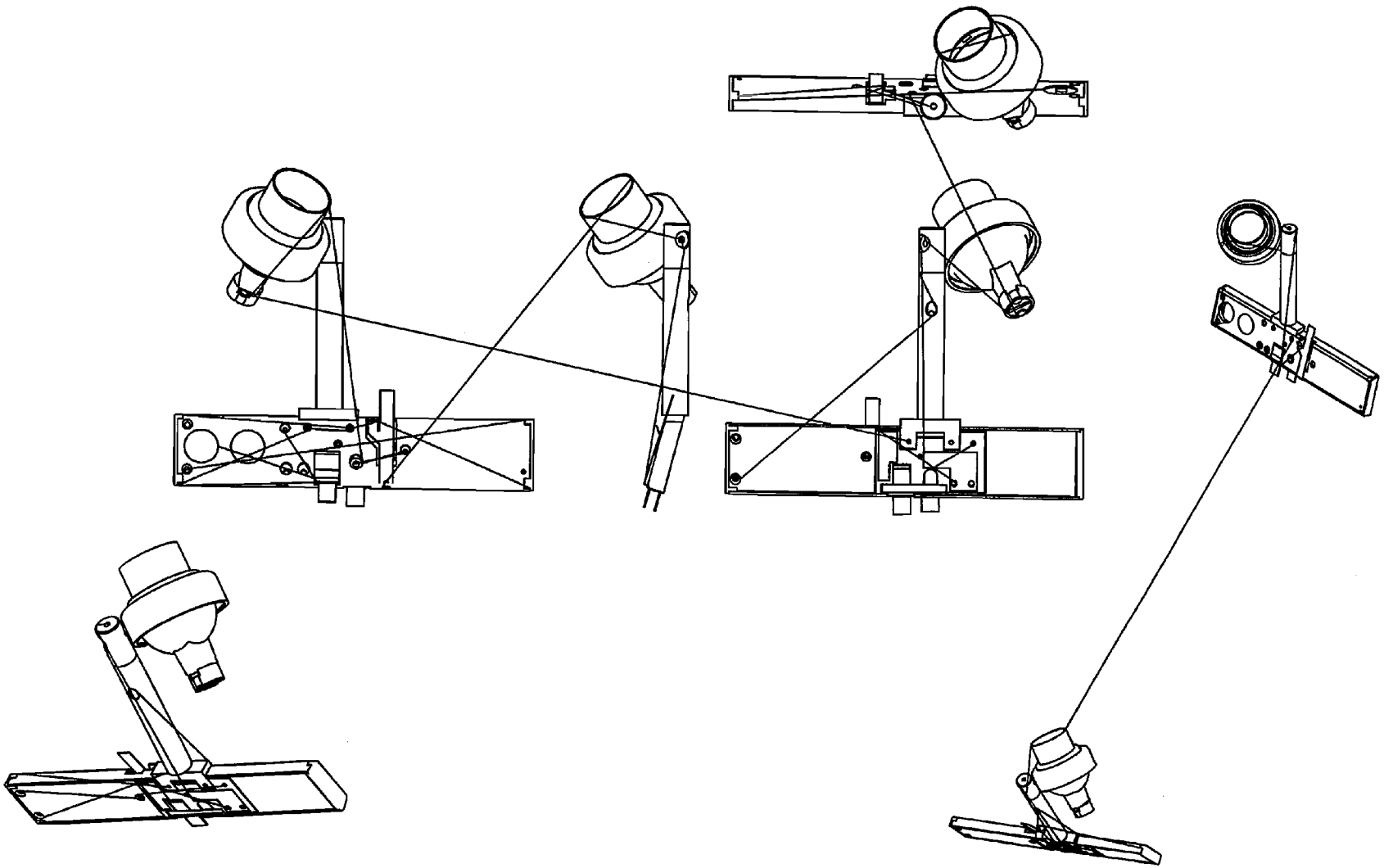
FIG. 3 shows other views of an exemplary lighting fixture and transformer according to the present invention.
Figure 4:
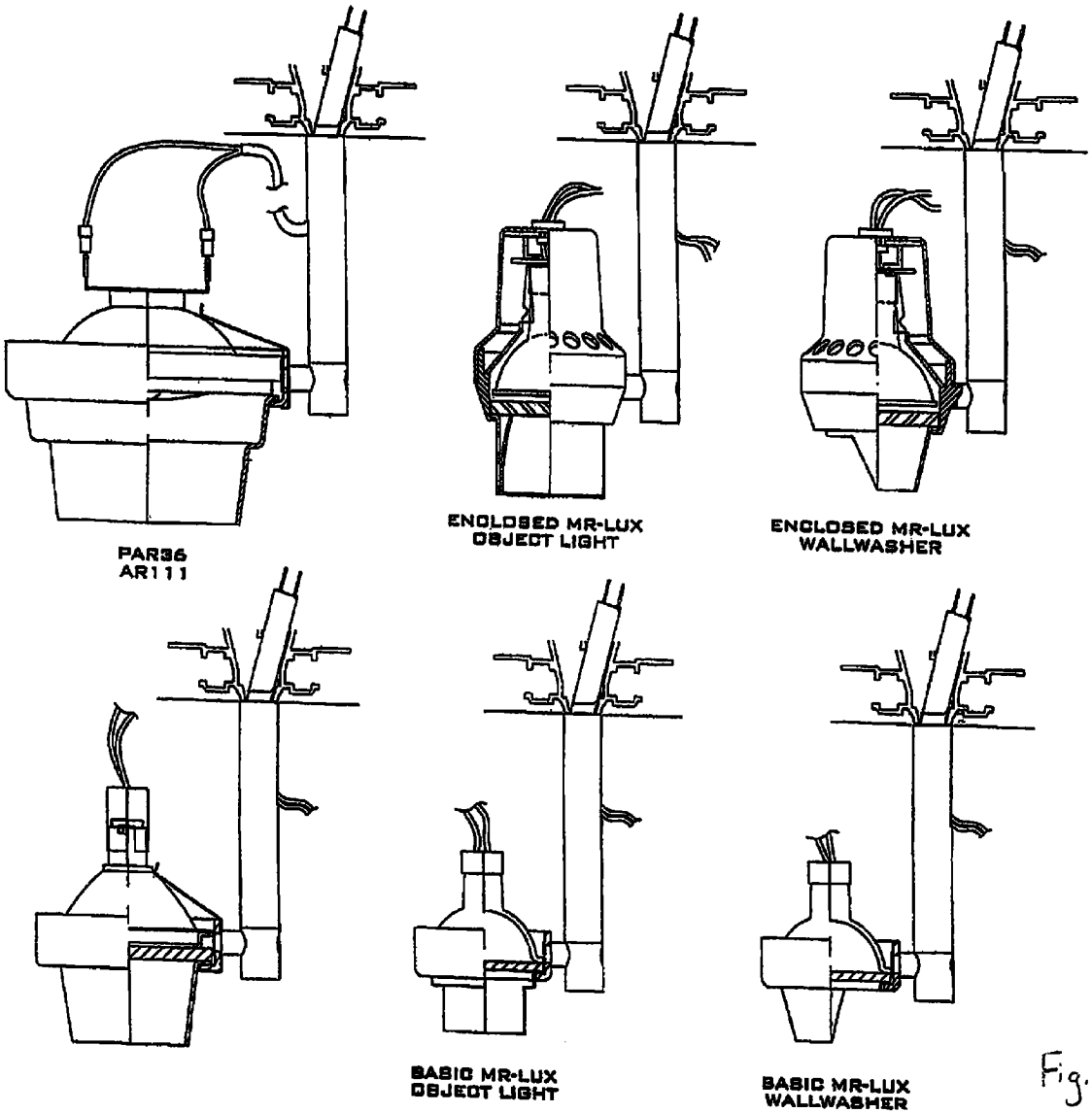
FIG. 4 shows other views of exemplary lighting fixtures and transformers electrically connected to the track.
Figure 5:
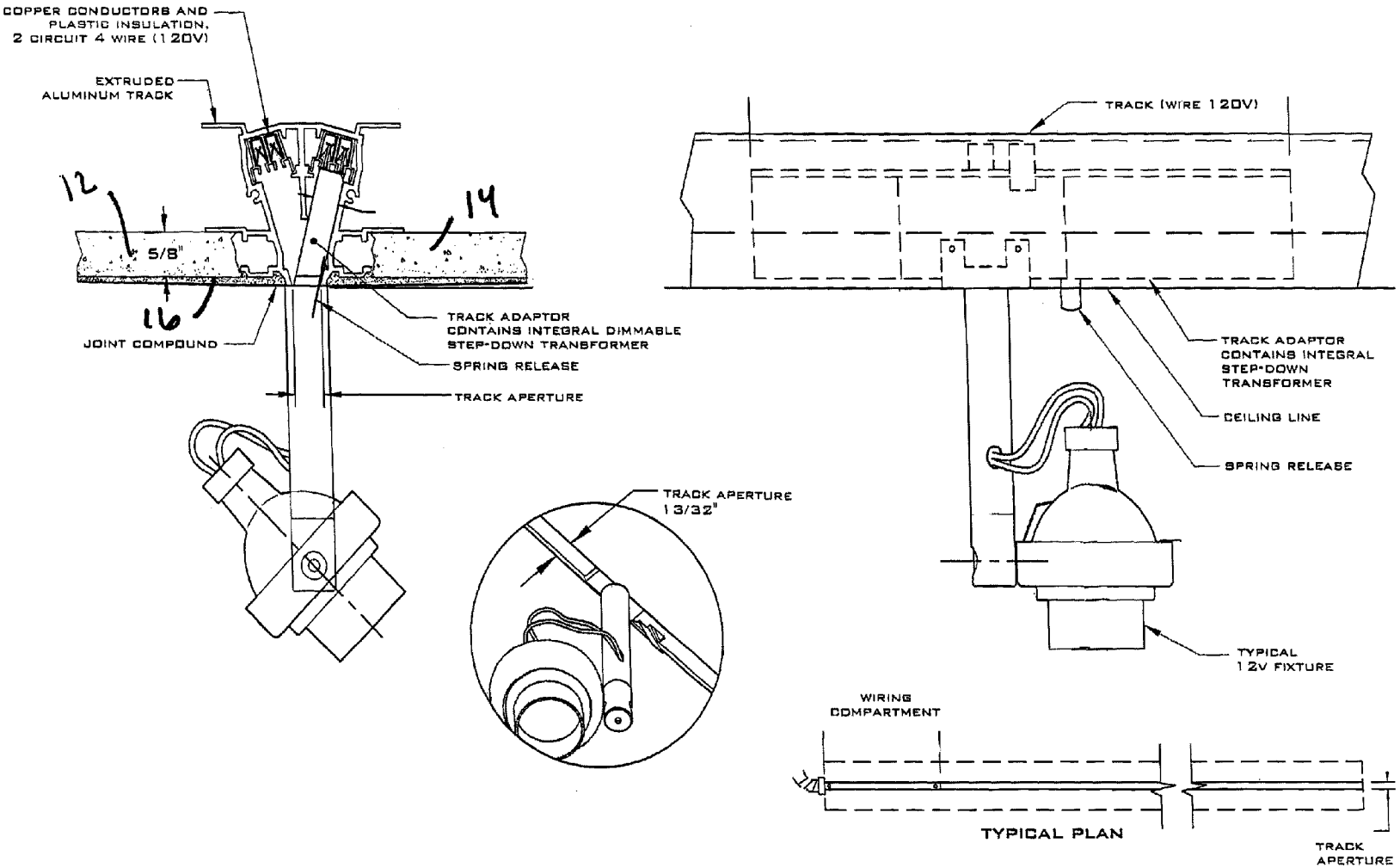
FIG. 5 shows other views of an exemplary lighting fixture and transformer electrically connected to the track.
Figure 6:
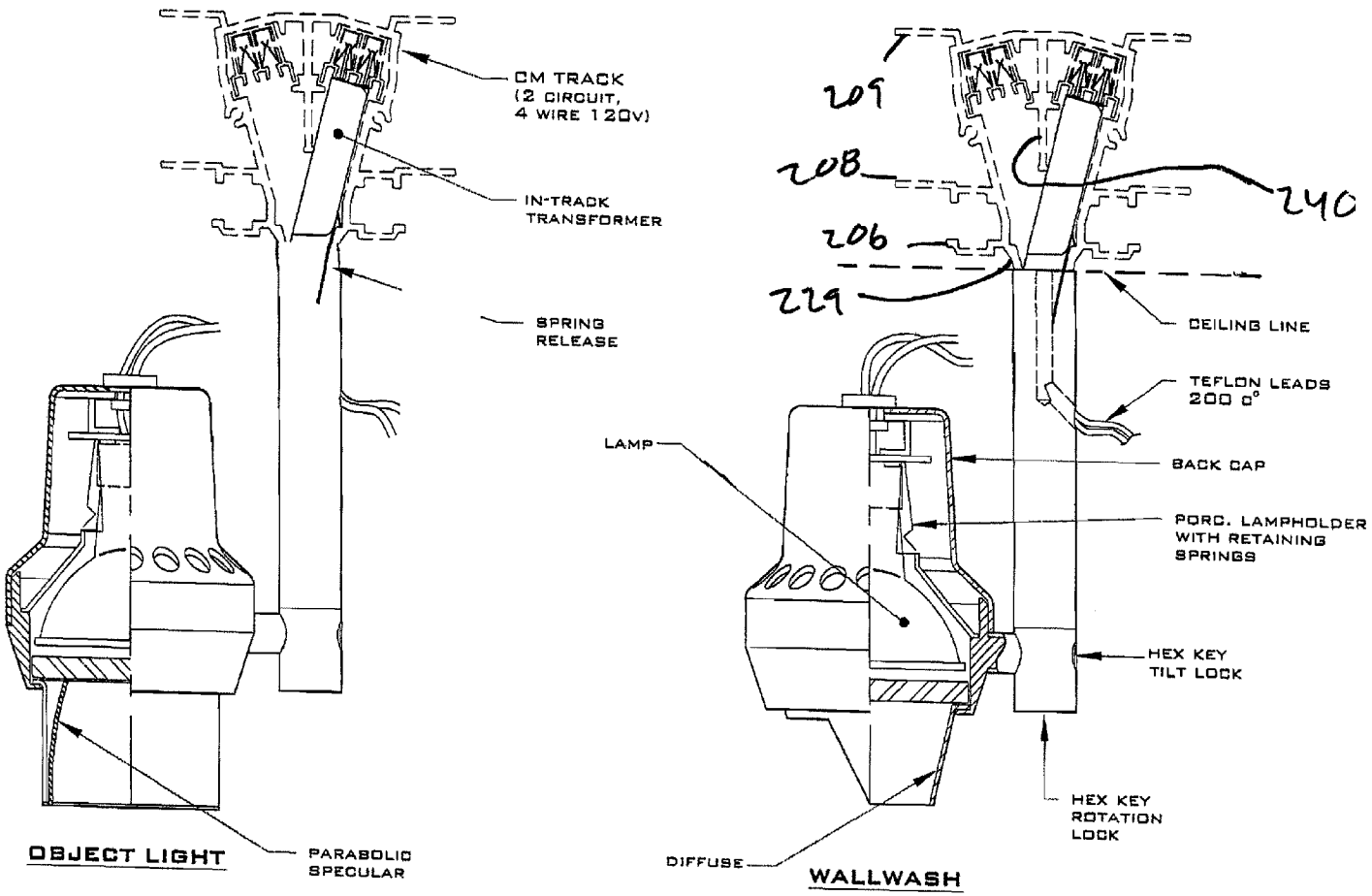
FIG. 6 shows other views of an exemplary lighting fixture and transformer electrically connected to the track.
Figure 7:
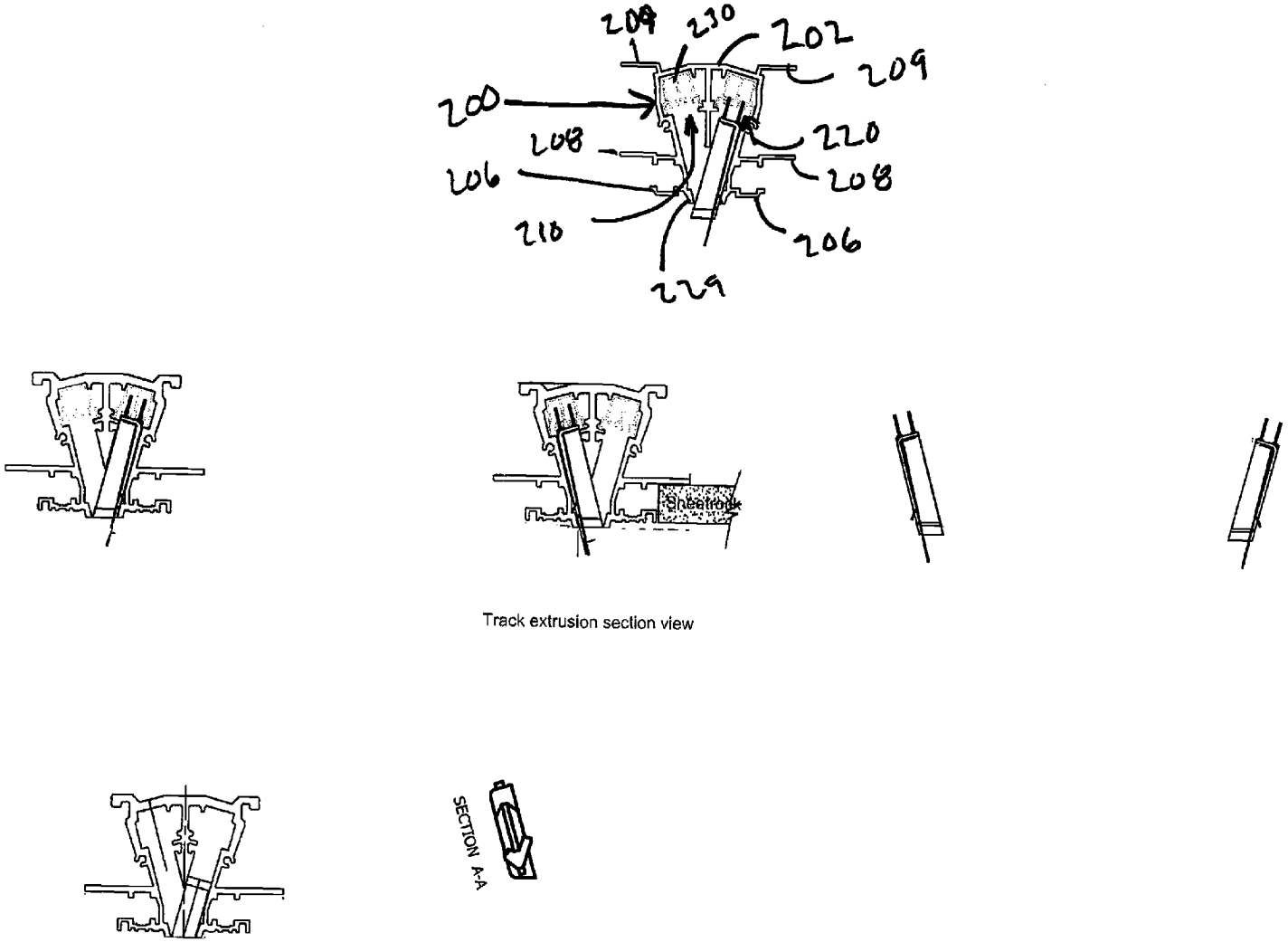
FIG. 7 shows close-up views of a stem of the transformer mated to the two track circuits.
Figure 8:
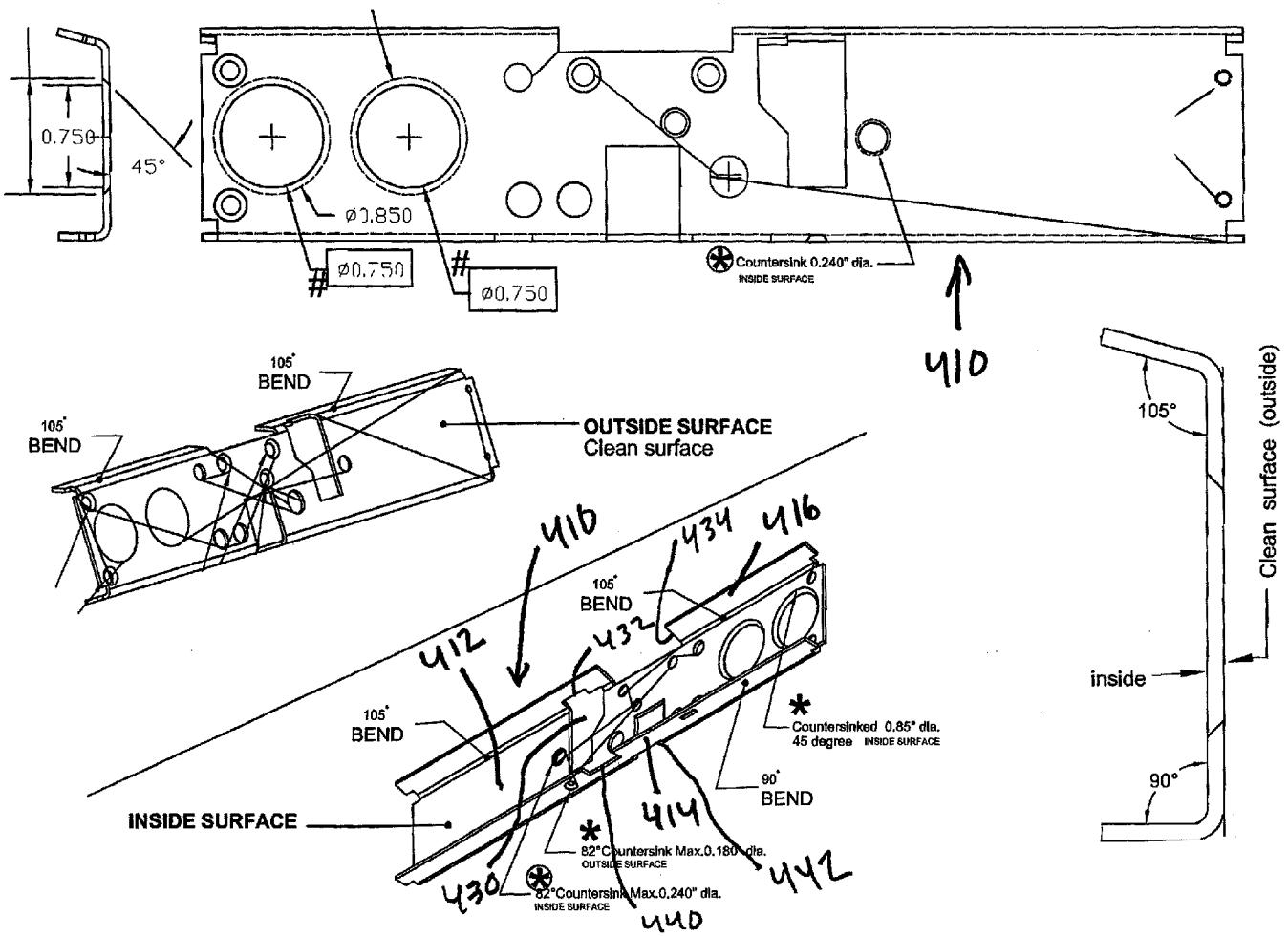
FIG. 8 shows views of an outer housing of the transformer.

As shown in FIGS. 2 and 8, the transformer 400 includes a housing or shell 410 that contains the electrical components of the transformer 400. The shell 410 is generally C-shaped and includes a main side wall 412, a top wall 414 and a bottom wall 416 that are attached at the upper and lower edges, respectively, of the side wall 412. The walls 414, 416 extend inwardly from the side wall 412 and in the illustrated embodiment, an angle between the wall 416 and the side wall 412 is about 105 degrees and an angle between the wall 414 and the side wall 412 is about 90 degrees. The side wall 412 can contain a number of openings and slots to permit different components of the transformer 400 to pass through the side wall 412. For example, the side wall 412 can contain a first opening 430 that is formed in the side wall 412 and terminates in a first slot 432 that is formed in the bottom wall 416; a stem slot 434 that is formed in the bottom wall 416 for receiving the stem 320, a first contact slot 440 formed in the top wall 414 and a second contact slot 442 formed in the top wall 414. The first and second contact slots 440, 442 are formed on opposite edges of the top wall 414 in an offset manner so that the slots 440, 442 are not directly opposite one another.

The shell 410 is typically formed of metal.

The transformer 400 includes internal electronic components (PCB assembly) 500 that serve to electrically connect the lamp 310 to the track 200. In one aspect of the present invention, the transformer 400 has been constructed and in particular, the electronic components 500 have been arranged so that the transformer 400 has a reduced width compared to prior art transformers. In one embodiment, the transformer 400 has a width of about ⅜ inch (in contrast, conventional transformers have a width of at least ¾ inch—which is substantially greater that the width of the transformer 400). The transformer 400 of the present invention is thus configured to be longer and thinner than existing designs to provide the aesthetic pleasing look discussed herein due to the track having a small, less obtrusive looking entrance.

Figure 13:
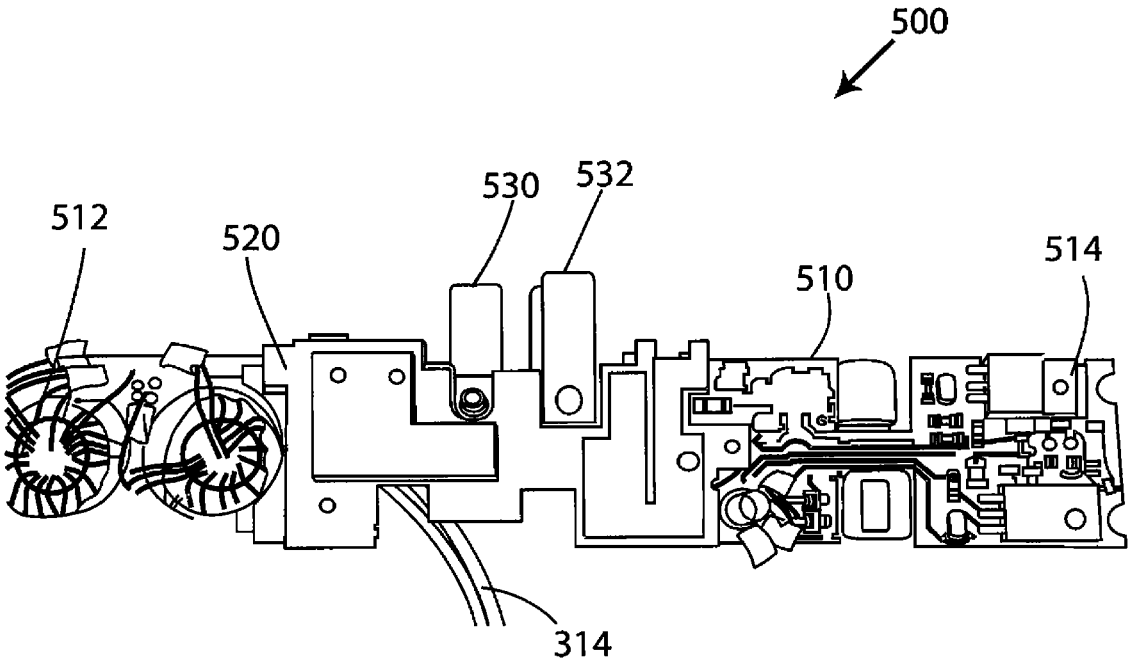
FIG. 13 is a side elevation view of a printed circuit board assembly.

As shown in FIG. 13, the electronic components 500 includes a printed circuit board 510 that has a toroid end 512 and an opposite transistor end 514. Terminal ends of the wires 314 are attached to the printed circuit board 510.

Figure 14:
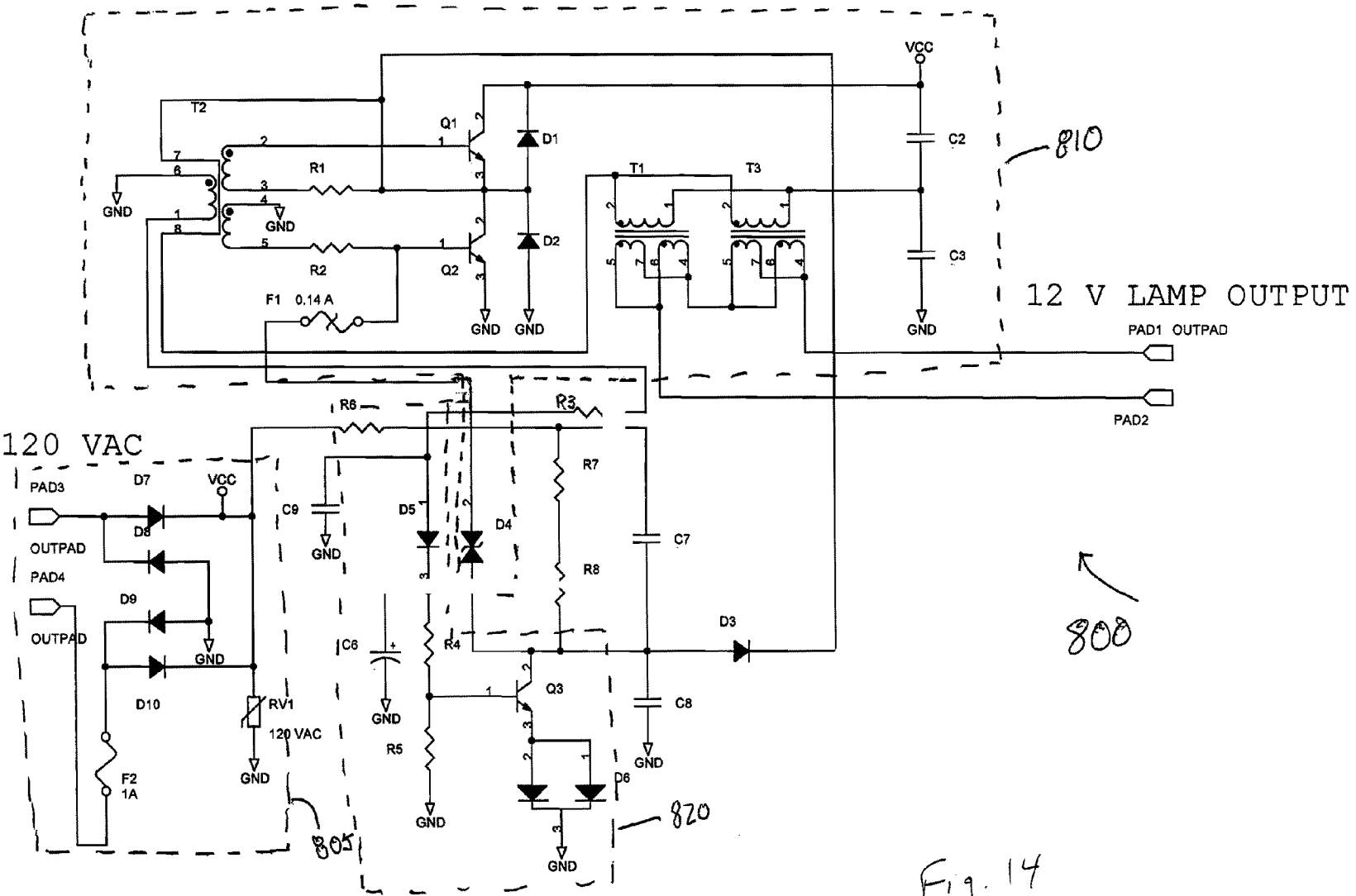
FIG. 14 is a schematic drawing of the printed circuit board assembly of FIG. 14.

FIG. 14 is a schematic drawing of the components of printed circuit board 510. The circuit 800 includes a full wave rectifier 805, a driver stage 810, and a protection circuit 820. The full wave rectifier 805 includes four diodes D7, D8, D9, D10 and provides a full wave rectified DC voltage as its output (Vcc). This DC voltage has a ripple frequency of twice the input voltage frequency (e.g., 120 Hz based on a 60 Hz input voltage frequency).

The driver stage 810 includes Zener diode D4, a pair of drive transistors Q1, Q2, output transformers T1, T2, bias transformer T3, and discrete elements as depicted in FIG. 14. Conduction of transistors Q1 and Q2 occurs on an alternating basis. Capacitors C2 and C3 create a voltage divider, which when transistor Q2 is in conduction, sources current through the primary windings of output transformers T1, T3. Current flows through the single-turn primary winding of bias transformer T2 and is sunk to ground through conducting transistor Q2. When transistor Q1 is in conduction, current is sourced through transistor Q1 and the primary winding of bias transformer T2 to the primary winding of output transformers T1, T3. This alternating flow of current through the primary windings of transformers T1 and T3 creates an AC output voltage. The frequency of the AC output voltage is dependent on the induction characteristics of bias transformer T2 and capacitors C2, C3.

When Zener diode D4 is reversed biased a voltage is present at the base of transistor Q2 causing transistor Q2 to conduct and effectively short the output transformers T1, T3 to ground. As the voltage across diode D3 increases the diode D3 becomes forward biased, effectively shorting the junction of Zener diode D4 and the collector of transistor Q3 to ground through transistor Q2. With the Zener diode shorted to ground, there is no bias voltage on the base of transistor Q2 causing it to not conduct. With no conduction through transistor Q2, the voltage at the junction of transistors Q1, Q2 will begin to raise at a rate determined by the value of capacitors C2, C3, the inductance of the first secondary winding of transformer T2, and the resistor R1. The base-emitter junction of transistor Q1 becomes forward biased and transistor Q3 begins to conduct. Conduction of transistor Q1 sources current through the primary windings of bias transformer T2 and output transformers T1, T3. This current flow is in an opposite direction from the flow of current when transistor Q2 is conducting.

As transistor Q1 continues to conduct, the diode D3 becomes reversed biased and the voltage across the Zener diode D4 begins to increase. At the Zener threshold, the base-emitter junction of transistor Q2 is activated forcing the output of transistor Q3 to ground, reversing the flow of current through the primary windings of the bias transformer T2 and the output transformers T1, T2. This cycle of conduction between transistors Q1, Q2 repeats at a high frequency (e.g., 50 KHz), and provides the output drive voltage to power the lamp.

The protection circuit 820 offers both overcurrent protection and thermal protection. Protection circuit includes transistor Q3, diode D6 (which in combination act as thermal protection), an overvoltage detector (formed from diode D5 and capacitor C6), and discrete components as depicted in FIG. 14. Current flows through the primary winding of bias transformer T2 when either of transistors Q1, Q2 are conducting, and is coupled to the secondary windings of the bias transformer T2. Current through secondary winding terminals ⅙ is half-wave rectified by diode D5, and sets a voltage level at the base of transistor Q3 proportionate to the ratio of resistors R4, R5. This voltage level is not enough to turn on the base-emitter junction and the junctions of diode package D6. Current flow through diode D5 also charges the capacitor D6. Under normal operating conditions, capacitor C6 will discharge on opposite cycles as transistors Q1 and Q2 conduct, as described above. However, at to startup or abnormal conditions, capacitor C6 continues to charge until the voltage at the base of Q3 is sufficient enough to turn on Q3. Conduction of Q3 effectively shorts the Zener diode D4 to ground through diodes D6. This will stop the alternating conduction of transistors Q1, Q2 and shut off any output voltage at the secondary windings of output transformers T1, T3.

Thermal protection is offered through the inherent temperature properties of transistor Q3 and diodes D6. As the operating temperature increases, the breakdown voltages of the base-emitter junction and the diodes decrease. Thus, at higher temperatures capacitor C6 need charge to a lower level in order to turn on transistor Q3 and cause the circuit to shutdown.

Figure 11:
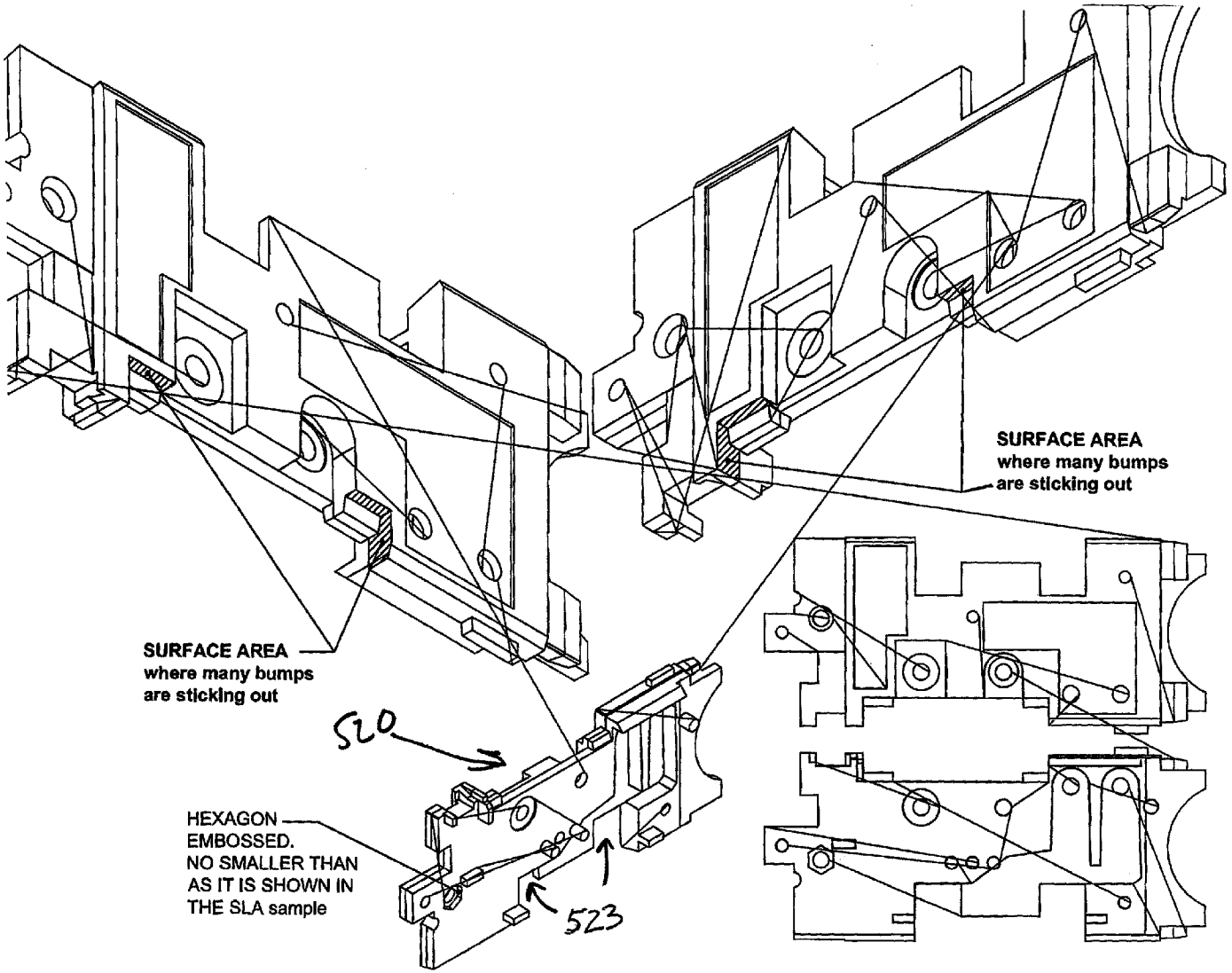
FIG. 11 shows a first internal part of the transformer.

As shown in FIG. 11, an insulating member or side attachment 520 is attached to one side (one face) of the printed circuit board. The member 520 is formed of an insulating material, such as plastic. The member 520 has a number of cutouts or slots 522 that can serve a number of different purposes, including the ability to route different components therethrough. For example, a pair of slots 523 is provided to permit two legs 313 of a hub 311 (FIG. 2) of the light fixture 310 to be received therein when the light fixture 300 is mated to the transformer 200.

A first transformer contact 530 (e.g., copper contact) is electrically connected to the printed circuit board 510 and in particular passes through an opening formed in the insulating member 520. A second transformer contact 532 is also electrically connected to the printed circuit board 510 and passes through an opening formed in the insulating member 520. Each of the illustrated contacts 530, 532 has a rectangular shape. The contacts 530, 532 are formed on opposite sides of the printed circuit board 510, with one contact 530 being inserted through the second contact slot 442 formed in the top wall 414 and the other contact 532 is inserted through the first contact slot 440 formed in the top wall 414.

Figure 12:
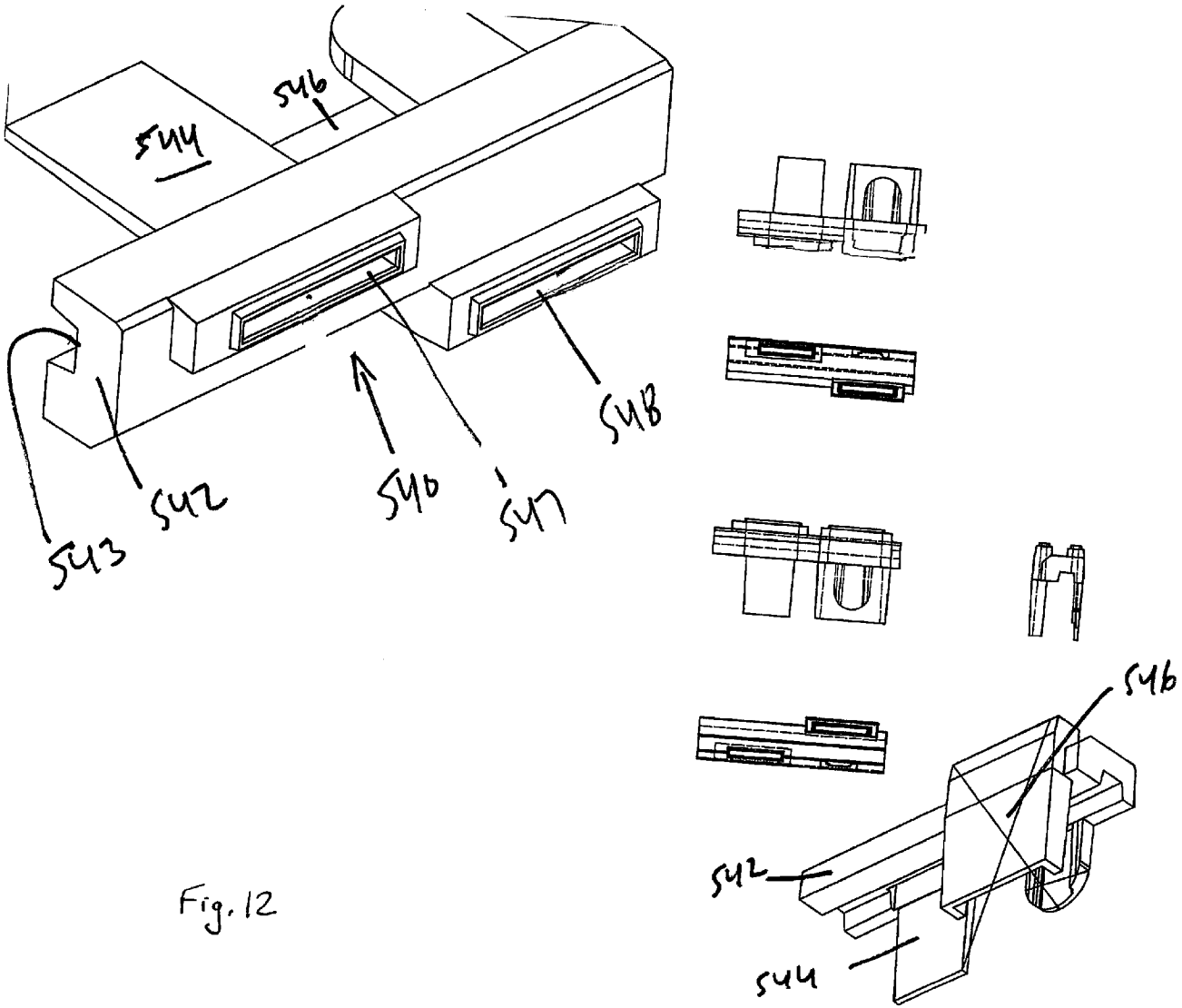
FIG. 12 shows an internal contact holder part of the transformer

As shown in FIG. 12, the contacts 530, 532 are closed and covered in part with a holder component 540. The holder component 540 is formed of an insulating material (plastic) and includes a main rail 542 that has a recessed channel 543 that seats against top edges of the printed circuit board 510 and the insulating member 520. On either side of the rail 542, first and second shield members 544, 546 are provided and terminate in openings 547, 548, respectively, through which the contacts 532, 530 pass and extend beyond the holder component 540 so as to be available for electrical connection within one of the first and second track sections 210, 220 (i.e., within the conductors 236 thereof). The holder component 540 is attached to the member 520.

As shown in FIG. 2, the transformer 400 includes a single spring release 600 that functions to lock and release the transformer from the track 200. Due to the unique angled nature of the first and second tracks 210, 220, the transformer 400 of the present invention only requires a single spring release 600 that is designed to release the transformer 400 from its engaged state within the track 200. In contrast, conventional transformers includes two or more spring releases. The spring release 600 is a metal member that has a prong section 610 that extends beyond the bottom wall 416 of the shell 410 and lies outside of the track 200 when the transformer 400 is inserted and coupled to the track 200. The spring release 600 includes a resiliently biased tab section 620 (bent tab) that is biased outward so as to engage the underside of one rail 229 so as to lock the transformer within either the first track section 210 or the second track section 220.

The spring release 600 is disposed within the first opening 430 of the sidewall 412 and the prong section 610 extends through the first slot 432.

After the PCB assembly 500 is completed, it is then disposed within and secured to the shell 410 of the transformer 400 using conventional techniques, such as using fasteners and the like. As shown in FIG. 2, a first cover 700 is then placed over the transistor end 514 of the printed circuit board 510 and is securely attached to the shell 410 so as to cover the underling PCB 510. Similarly, a second cover 710 is placed over the toroid end 512 of the printed circuit board 510 and is then securely attached to the shell 410 so as to cover the underlying toroids of the PCB 510.

The assembled PCB assembly 500 is thus securely attached to the lighting fixture 300 by means of the hub 311 of the light fixture 310.

Figure 9:
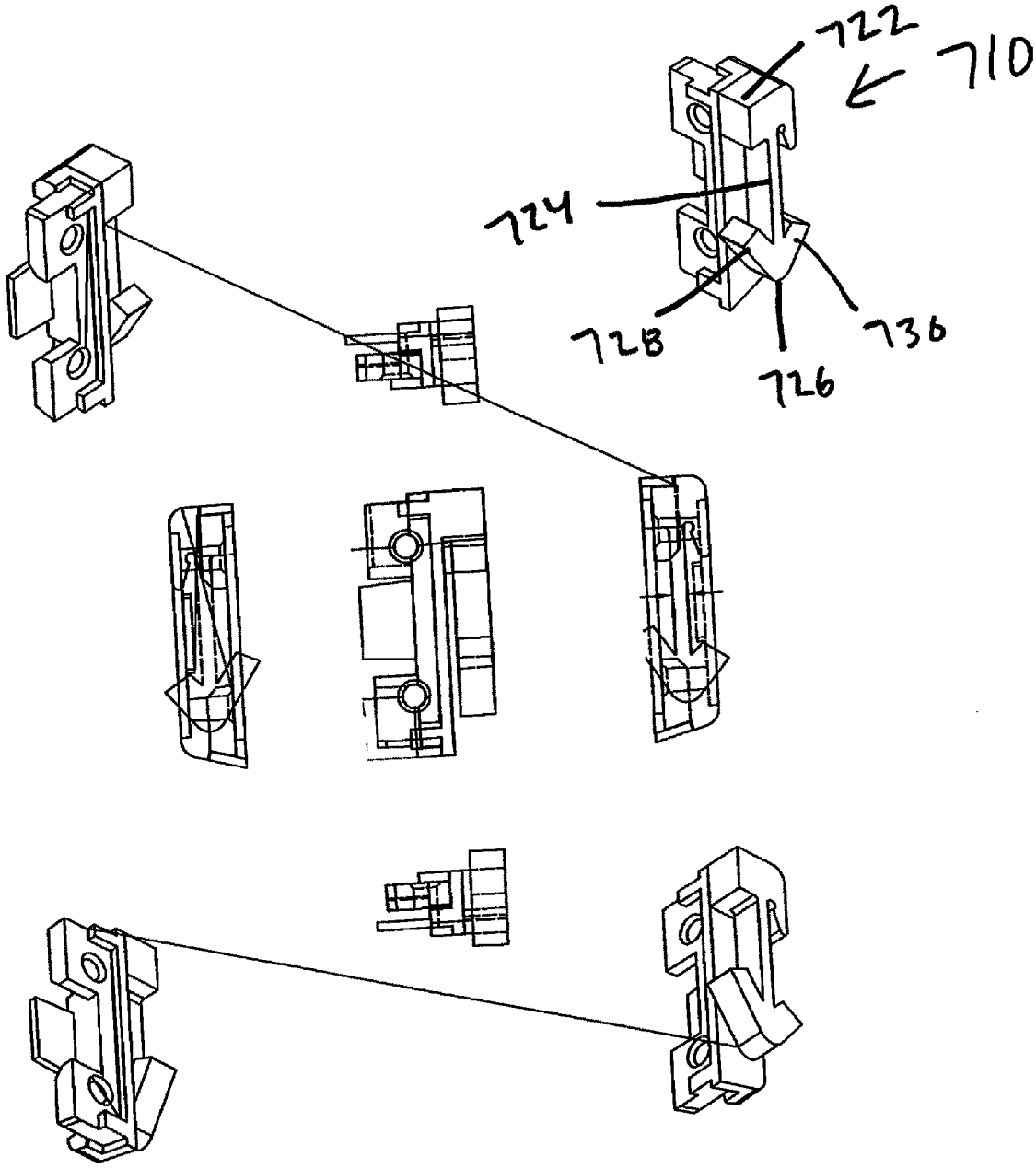
FIGS. 9 and 10 show views of a safety and locator feature that is part of the transformer.
Figure 10:
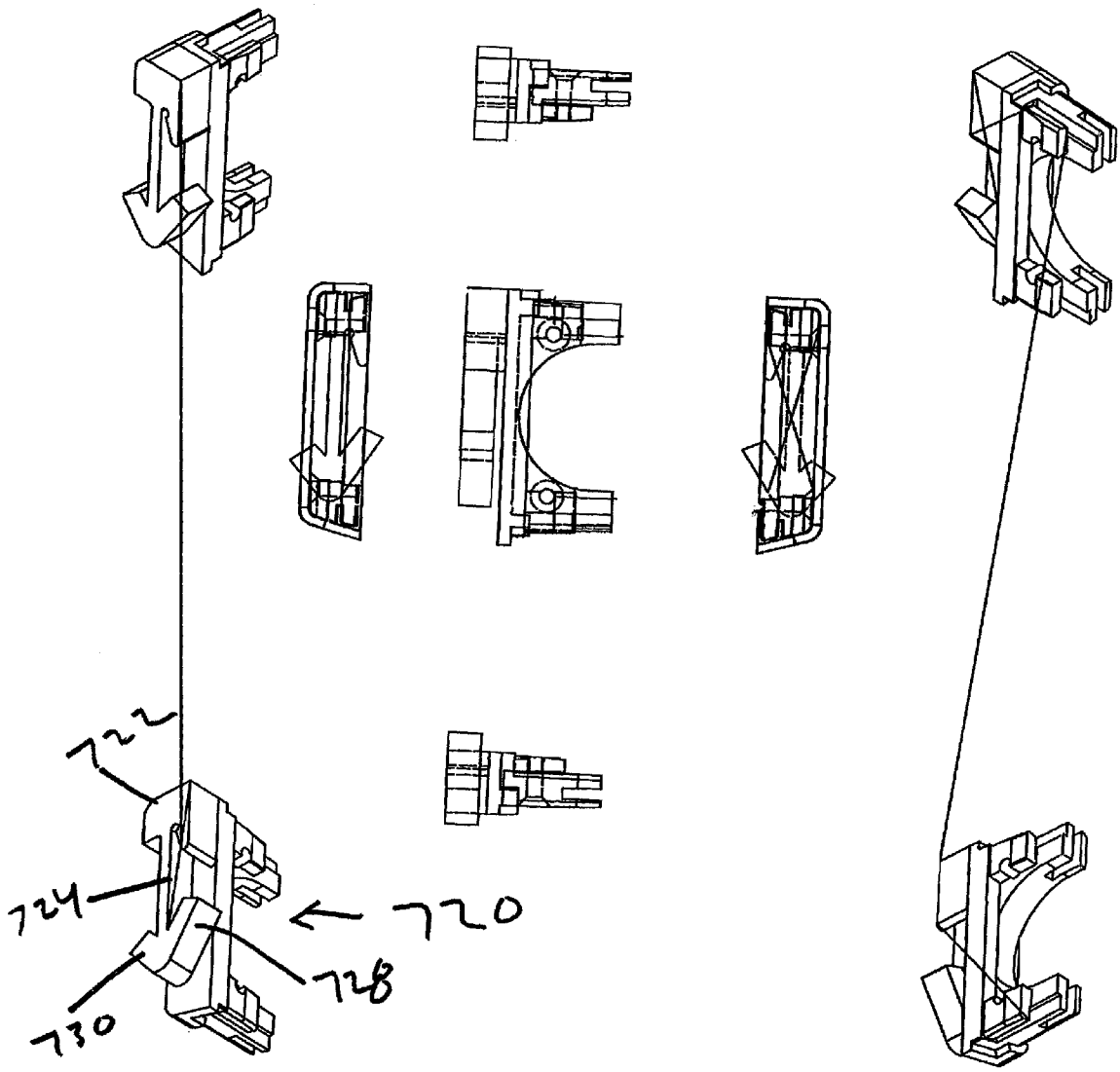

As shown in FIGS. 9 and 10, the transformer 400 includes a safety and locating feature located at each end that prevents the transformer 400 from being inserted into one of the tracks 200, 210 in its wrong orientation. In other words, if the transformer 400 is wrongly turned around in that the spring release 600 is facing the separating wall 240 as opposed to the outwardly extending flanges 206, the safety and locating feature prevents insertion of the transformer 400 into the track. In one embodiment, the safety and locating feature is in the form of a pair of resilient (flexible) locating arms 710, 720, with the locating arm 710 (FIG. 9) being formed at the transistor end of the transformer 400 and the locating arm 720 (FIG. 10) being located at the toroid end of the transformer 400.

Each of the arms 710, 720 includes a base portion 722 that is positioned proximate the bottom wall 416 of the shell 410. A flexible extension or finger 724 extends from the base portion 722 and terminates in an arrow shaped end 726 in that it includes a first angled tab 728 and a second angled tab 730 that join one another at one end and are both angled relative to the extension 724. The lengths of the tabs 728, 730 are different and therefore, when the user places the transformer 400 into the track 200 in its correct orientation, the longer first tab 728 first contacts one of the rails 229 and due to both of their constructions and the resilient nature of the arm 710, 720, the arm flexes inward toward the other rail 729 to permit clearance of the first tab 728 past the rail 729 and into the opening (entrance 230). The second tab 730 then contacts the other rail 729 and once again, the construction of the arm and rail causes the arm to flex inward back toward the other rail 729 to permit clearance of the second tab 730. At this time, the complete arm structure 710, 720 is located within the track 200 and the transformer 400 can be properly inserted into the track section to permit an electrical connection to be formed between the respective contacts.

Conversely, if the transformer 400 is in the wrong orientation, the tabs 728, 730 engage the opposite rails 229 (which have different angled orientation now) and the tabs 728, 730 cannot pass between the rails 729 into the entrance 730. In effect, the arms 728, 730 lock onto the rails 229 and prevent insertion of the transformer into the wrong track section, thereby preventing the wrong insertion thereof.

The wrong orientation of the transformer 400 will also be readily apparent to the user since the stem 320 will no longer be in a perpendicular orientation but instead will be at an angle relative to the track 200. Thus, in one aspect of the present invention, the lighting fixture 300, transformer 400 and track 200 are all constructed so that regardless of whether the transformer 400 is inserted into either the first track section 200 or the second track section 210, the stem 320 is perpendicular to the track 200 even though the track sections 200, 210 are angled inward toward one another so long as the orientation of the transformer is correct for the given track section 200, 210 as discussed above.

The track lighting system 100 offers a number of advantages that are bundled into a pleasing consumer product that is aesthetically pleasing, while at the same time electronic performance is not diminished. For example, the following are some but not all of the advantages of system 100:

1. light fixture and track are made smaller and the entrance to track is significantly reduced compared to existing designs;
2. each light fixture has its own transformer that is received and contained within the track;
3. providing two angled track sections within the track member, each track section having its own associated circuit, wherein when the transformer and light fixture are configured so that when they are correctly inserted into the proper track, the stem of the light fixture is always perpendicular to the track despite the tracks being angled relative to the support structure (ceiling or wall) and angled relative to one another;
4. use of only a single spring release compared to 2-4 that are typically used in conventional devices—by designing the two track sections to be angled, the transformer will rest against and be support by a side wall of the track section due to gravitational forces and therefore, only a single spring release is needed to lock the transformer to the side wall that it is not resting against due to gravity;
5. the track has a single entrance that leads to the two angled track sections; and
6. locating and safety features to prevent the insertion of the transformer into the track in the wrong orientation.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one embodiment to another are also fully intended and contemplated. It is also to be understood that the drawings are not necessarily drawn to scale, but that they are merely conceptual in nature. Any dimensions listed in the drawings are merely for illustrative purposes only and do not limit the scope of the invention. The invention is defined solely with regard to the claims appended hereto, and equivalents of the recitations therein.

I claim:

1. A track lighting system comprising:

an extruded track body, comprising:

a first track section and a second track section adjacent to the first track section;

a pair of spaced rails defining an entrance into the extruded track body, wherein the defined entrance is common to both the first track section and the second track section;

a respective conductive member disposed at a bottom of each of the first track section and the second track section, wherein the conductive member is connectable to an electrical power source so as to form two independent circuits within the extruded track body; and a separating wall positioned between the first track and the second track;

a light fixture insertable through the entrance so as to make electrical connection with one of the respective conductive members, the light fixture comprising:

a socket housing containing a socket, a stem connecting the socket housing to a transformer housing containing an electrical circuit having an output transformer;

a lamp in electrical connection with the socket, and connected to the output transformer by wires disposed within the stem; and the transformer housing including a top wall having first and second contact slots formed therein.

2. The system of claim 1, wherein the extruded track body further includes a plurality of outwardly extending flanges configured to engage a support structure.

3. The system of claim 1, wherein each respective conductive member comprises an insulating material, a pair of slotted sections separated by a center wall, wherein a conductor is disposed within each slotted section.

4. The system of claim 1, wherein the separating wall is configured to cause the lighting fixture to enter one of the first track section and the second track section dependent on an angle of incidence between the lighting fixture and the extruded track body entrance.

5. The system of claim 1, wherein the light fixture is configured so that it is insertable into one of the first track section and the second track section based on an orientation of the light fixture with respect to the entrance.

6. The system of claim 1, wherein, insertion of the light fixture into the extruded track body causes the first and second contact slots to engage the conductive member so as to complete an electrical connection to the electrical circuit.

7. The system of claim 1, wherein the transformer housing further includes one spring release configured to lock and release the transformer housing in the extruded track body, wherein the spring release includes an outwardly resiliently biased tab section.

8. The system of claim 1, wherein the tab section engages an interior portion of the extruded track body so as to lock the lighting fixture to the extruded track body.

9. The system of claim 1, wherein the transformer housing includes a safety and locating feature configured to prevent the transformer housing from being inserted into the one of the track sections in a wrong orientation.

10. An extruded track body comprising:

a first track section and a second track section adjacent to the first track section, wherein the first track section and second track section are angled relative to one another such that a first axis extending through a center of the first track section intersects a second axis that extends through a center of the second track section;

a pair of spaced rails defining an entrance into the extruded track body, wherein the defined entrance is common to both the first track section and the second track section;

a respective conductive member disposed at a bottom of each of the first track section and the second track section, wherein the conductive member is connectable to an electrical power source so as to form two independent circuits within the extruded track body; and a separating wall positioned between the first track and the second track.

11. A track lighting system comprising:

an extruded track body comprising:

a first track section and a second track section adjacent to the first track section, wherein the first track section and the second track section are angled relative to one another;

a pair of spaced rails defining an entrance into the extruded track body, wherein the defined entrance is common to both the first track section and the second track section;

a respective conductive member disposed at a bottom of each of the first track section and the second track section, wherein the conductive member is connectable to an electrical power source so as to form two independent circuits within the extruded track body; and a separating wall positioned between the first track and the second track; and a light fixture insertable through the entrance so as to make electrical connection with one of the respective conductive members, the light fixture comprising:

a socket and a stem connecting the socket to a transformer housing containing an electrical circuit having an output transformer;

a lamp in electrical connection with the socket and electrically connected to the output transformer;

wherein the transformer housing is disposed at an angle relative to the stem such that the transformer can be received within one of the angled first and second track sections such that when the transformer is inserted in a wrong orientation with respect to one of the first and second track sections, the stem is not perpendicular to the track body, while when the transformer is inserted into one of the first and second track sections in a proper orientation, the stem is oriented perpendicular to the track body.

12. The track lighting system of claim 11, wherein the transformer housing includes a safety and locating feature configured to prevent the transformer housing from being inserted into the one of the track sections in the wrong orientation.

13. The track lighting system of claim 12, wherein the safety and locating feature is located at ends of the transformer housing and includes a flexible finger that extends from a base portion and terminates in an arrow shaped end that includes first and second angled tabs of different length, wherein when the transformer is inserted in the wrong orientation, the first and second angled tabs cannot pass between the rails into the entrance.

14. The system of claim 12, wherein the separating wall is configured to cause the lighting fixture to enter one of the first track section and the second track section dependent on an angle of incidence between the lighting fixture and the extruded track body entrance.

15. The system of claim 12, wherein the light fixture is configured so that it is insertable into one of the first track section and the second track section based on an orientation of the light fixture with respect to the entrance.

* * * * *